US006899092B2

(12) United States Patent
Arens

(10) Patent No.: US 6,899,092 B2
(45) Date of Patent: May 31, 2005

(54) SYSTEM AND METHOD FOR INCREASING SPARK CURRENT TO SPARK PLUGS

(76) Inventor: Ulf Arens, 11305 Forestview La., San Diego, CA (US) 92131

( * ) Notice: Subject to any disclaimer, the term of this patent is extended or adjusted under 35 U.S.C. 154(b) by 137 days.

(21) Appl. No.: 10/206,714

(22) Filed: Jul. 27, 2002

(65) Prior Publication Data

US 2004/0016424 A1 Jan. 29, 2004

(51) Int. Cl.[7] ..... F02P 3/02
(52) U.S. Cl. ..... 123/620; 123/655
(58) Field of Search ..... 123/596, 599, 123/605, 618, 620, 634, 653, 654, 655, 601

(56) References Cited

U.S. PATENT DOCUMENTS 3,893,439 A * 7/1975 Chudoba ..... 123/149 R
3,943,905 A * 3/1976 Hartig ..... 123/604
4,829,972 A * 5/1989 Montano ..... 123/599
4,964,377 A * 10/1990 Scarnera ..... 123/605
4,998,526 A * 3/1991 Gokhale ..... 123/598
5,506,478 A * 4/1996 Daetz ..... 315/209 T

* cited by examiner

*Primary Examiner*—Mahmoud Gimie
(74) *Attorney, Agent, or Firm*—Cherskov & Flaynik

(57) ABSTRACT

A system 10 for increasing electrical spark current to the spark plugs of an electronic ignition system for internal combustion engines includes a capacitor 12 parallel with a switch 14; a primary winding 16; a secondary winding 18 in series with a spark plug 20, the capacitor 12 and switch 14 being in series with the primary winding 16; and a battery 22 having a positive terminal connected to the primary winding 16, and a negative terminal connected to the capacitor 12, switch 14 and spark plug 20. The components cooperating to direct positive and negative electrical currents through the primary winding 16 whereby a peak to peak primary winding current occurs that induces a corresponding secondary winding current through said secondary winding 18.

30 Claims, 15 Drawing Sheets

SYSTEM AND METHOD FOR INCREASING SPARK CURRENT TO SPARK PLUGS

BACKGROUND OF THE INVENTION

1. Field of the Invention

The present invention relates generally to ignition systems for internal combustion engines and, more particularly, to systems that increase the spark current to the engine's spark plugs.

2. Background of the Prior Art

Ignition systems have long been used to provide spark current to the spark plugs of an internal combustion engine. Before electronic ignition systems, spark plugs were "fired" by energizing and de-energizing a primary winding in a coil via mechanical contacts that were in parallel with a capacitor (often called a condenser). The primary winding caused a current to flow from a secondary winding to a preselected spark plug. The contacts opened and closed to remove power from a battery that ultimately energized the primary winding. To avoid rapid deterioration of the contacts, the capacitor was added to "absorb" an arc that would otherwise occur across the contacts when they started to open. When the contacts closed, the capacitor would discharge then the cycle would repeat. With the advent of electronic ignition and solid state switches, arcing contacts and arc absorbing capacitors were deleted from ignition systems.

Irrespective of the ignition system being electronic or of an earlier vintage, the spark size, duration and firing time influence the combustion process inside the cylinders of the engine which correspondingly affects the power generated. A typical prior art electronic ignition system is depicted in FIG. 1 of the drawings. The system includes a battery 22 that provides an electrical current to a primary winding 16 when a transistor or solid state switch 14 is closed. When the switch 14 is opened, the current goes to zero and the magnetic field generated by the current collapses thereby inducing a high voltage in a secondary winding 18 resulting in a secondary current flowing through the winding 18 which generates a spark across the electrodes of a spark plug 20.

Power output from the engine increases when the magnitude of the secondary current is increased or when the rise time of the secondary current is decreased. To achieve either these objective, expensive components are added to the electronic ignition system and/or existing components are replaced. Prior art techniques for increasing power output have not considered storing energy from the primary winding 16 as the primary current goes to zero when the switch 14 is opened, then directing the stored energy as a reverse current flow back through the primary winding 16. The reverse current flow increases the peak-to-peak current through the primary winding, and correspondingly increases the current through the secondary winding which ultimately provides the spark current to the spark plugs.

A need exists in the art for a system and/or method that economically and quickly increases the current through the secondary winding and spark plug of an electronic ignition system for either newly manufactured or in use prior art designed electronic ignition systems.

SUMMARY OF THE INVENTION

It is an object of the present invention to provide a system and method for increasing spark current to the spark plugs of an internal combustion engine that utilizes electronic ignition to "fire" the spark plugs thereby overcoming many of the disadvantages of the prior art.

A principle object of the present invention is to provide a system that increases the current through the primary winding in the coil of the electronic ignition system for an internal combustion engine. A feature of the system is to direct positive and negative currents through the primary winding. An advantage of the system is that the resulting peak to peak primary current magnitude correspondingly increases a current output from a secondary winding in the coil that ultimately provides the spark to the spark plug.

Another object of the present invention is to provide a system that utilizes minimal components to increase the current through the primary winding in the coil of the electronic ignition system for an internal combustion engine. A feature of the system is to provide a capacitive device for directing currents through the primary winding. An advantage of the system is that one relatively small capacitor is connected to the primary winding such that energy is initially stored in the capacitor when the primary winding is energized. Another advantage of the system is that the capacitor easily directs current through the primary winding after the initial current through the primary winding has reduced to zero, the capacitor current being in a direction opposite to the initial current flowing thereby increasing the peak to peak magnitude of the primary winding current and correspondingly increasing the current output from the secondary winding.

Still another object of the present invention is to provide a system that incorporates the original components of the electronic ignition system for the internal combustion engine. A feature of the system is that a capacitor may be specified for any size electronic ignition system. An advantage of the system is that none of the components of an existing electronic ignition system need be replaced when adding a capacitor.

Yet another object of the present invention is to provide a system that promotes faster primary current rise time. A feature of the system is an inductor connected parallel with the primary winding to reduce the effective inductance of the primary winding. An advantage of the system is that a larger primary winding current is reached which results in a correspondingly larger spark current.

Briefly, the invention provides a system for increasing the spark current to the spark plugs of an electronic ignition system for internal combustion engines comprising a battery; an electrical coil having primary and secondary windings; switching means for energizing and de-energizing said primary winding; and means for directing positive and negative electrical currents through said primary winding whereby a peak to peak primary current occurs that induces a corresponding secondary winding current through said secondary winding.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
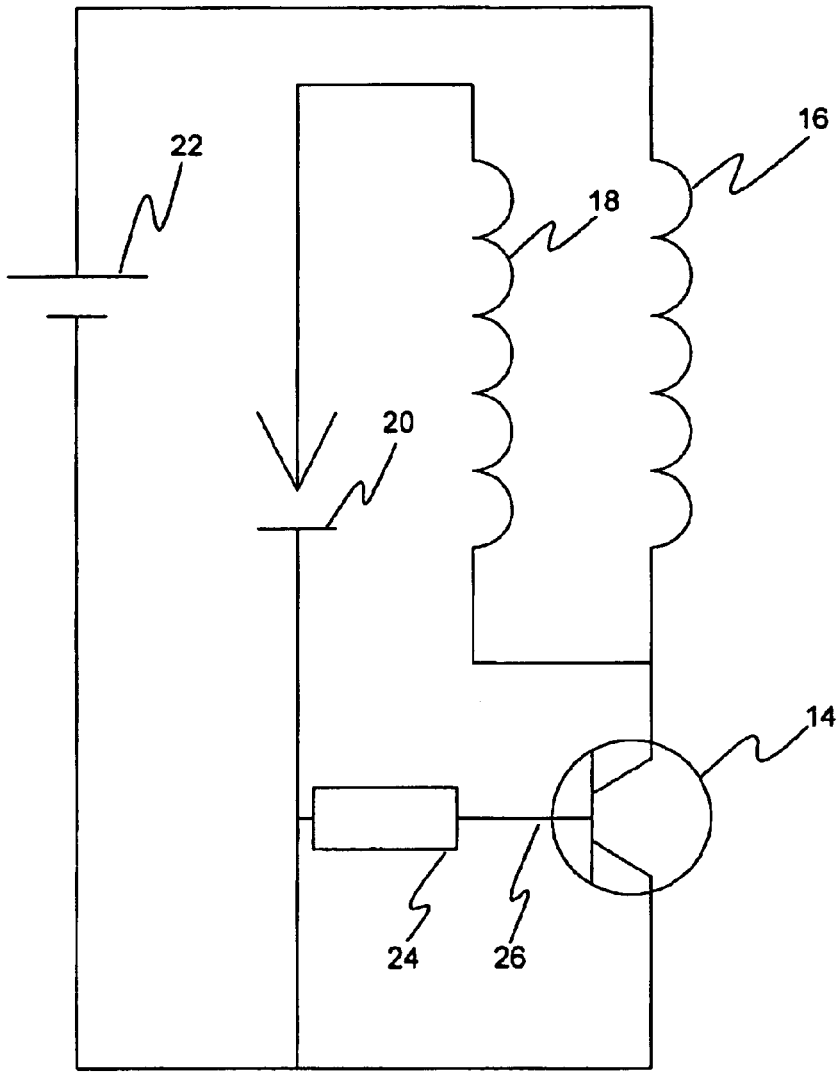
PRIOR ART Fig. 1
FIG. 1 is an electrical schematic drawing of a prior art electronic ignition system for an internal combustion engine.
Figure 2:
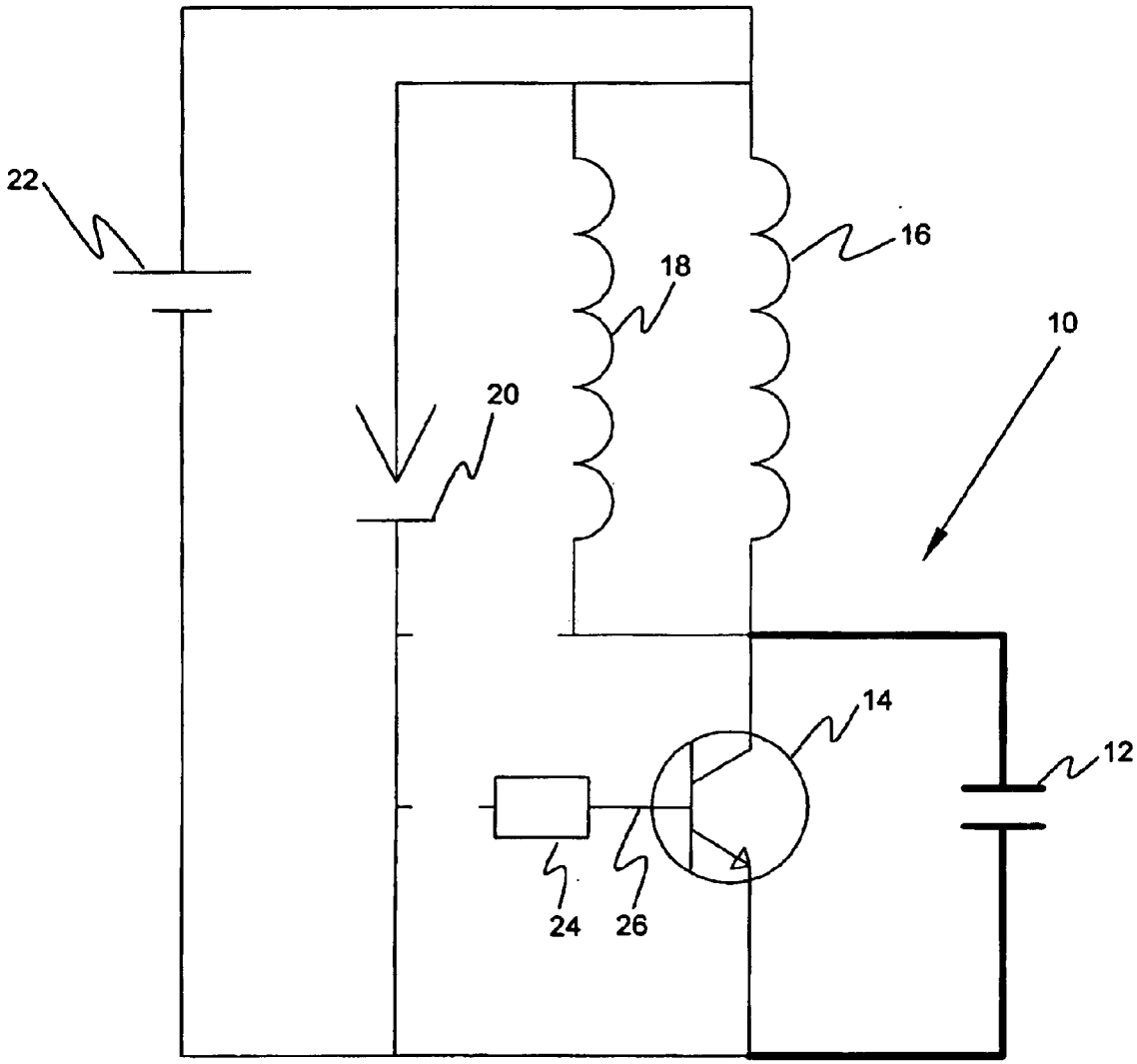
FIG. 2 is an electrical schematic drawing of a system for increasing spark current to the spark plugs of an internal combustion engine with electronic ignition in accordance with the present invention.

Referring now to the drawings and in particular to FIGS. 2 and 7–13, a system and method for increasing electrical spark current to the spark plugs of an internal combustion engine with electronic ignition in accordance with the present invention, is denoted by numeral 10. The system 10 includes a capacitive device 12 sized between 0.01 and 0.68 microfarads for the typical automobile. However, the present invention may be utilized with any size and model of spark plug installation for any vehicle including but not limited to motorcycles and trucks. The size and type of the spark plug installation determines the parameters of the capacitive device 12 which must be specified to cooperate with other components in the system 10 to achieve the desired spark intensity. Specifications for the capacitive device 12 is readily provided by one of ordinary skill in the art when ignition component parameters are provided.

The system components include a solid state switch 14 (NPN transistor) or similar circuit opening device that is disposed in parallel with the capacitive device 12, a primary winding 16, a secondary winding 18 in series with a spark plug 20, the capacitive device 12 and switch 14 being in series with the primary winding 16, and a battery 22 or similar power source having a positive terminal connected to the primary winding 16 and a negative terminal connected to the capacitive device 12, switch 14 and spark plug 20.

The capacitive device 12 or capacitor is a standard component, type number-MKP4 or MKS4, manufactured by WIMA, a German capacitor manufacturer. The capacitor 12 may be installed as an original element of the system 10, or the capacitor 12 may be added to an existing prior art electronic ignition system to provide increased electrical spark current to the prior art system. The transistor 14 is generally switched on and off by an engine control unit (ECU) 24 or similar computer module that operates the base portion 26 of the transistor 14. Irrespective of the manufacturer type of primary and secondary coils 16 and 18 (packaged in a sealed electrical enclosure termed a coil), spark plug 20 and battery 22 used for internal combustion engines, the specified capacitor will cause an opposing current flow through the primary winding 16 that will ultimately increase the magnitude of the peak-to-peak current flow through the primary winding 16, and correspondingly increase the magnitude of the current flow through the secondary winding 18. The current flow through the secondary winding 18 is usually in one direction (direct current), although the current flow under certain parameters can reverse direction repetitiously between positive and negative (alternating current).

In operation, the system 10 is similar to the prior art device of FIG. 1 when the switch 14 is turned on. More specifically, the battery 22 causes a current flow through only the primary winding 16. Upon turning off the switch 14, the primary winding 16 current goes to zero while charging the capacitor 12 via the battery 22, and the magnetic field of the primary winding 16 collapses to induce a corresponding secondary current through the secondary winding 18 and spark plug 20. The primary current falls from about eight amperes in a typical system 10 (see point A-A', FIGS. 7, 8 and 12), and the secondary current increases to about seventy milliamperes (see point B-B', FIG. 12).

In the present invention, as the primary current goes to zero, an oppositely flowing current generated by the discharging capacitor 12 starts to flow (see point C-C', FIGS. 9, 10, 11 and 13) that also reaches a magnitude of about eight amperes. The peak-to-peak measurement of the primary current is about sixteen amperes resulting in proximately a doubling of the secondary current to 144 milliamperes (see point D, FIG. 13). Due to the inherent operation of the windings 16,18 and capacitor 12, well known to those of ordinary skill in the art, the current flow through the primary winding 16 is both positive and negative, but the current flow through the secondary winding 18 is generally in one (positive) direction, which is conducive to the operation of the spark plug 20. However, occasionally system 10 component values will result in a secondary winding 18 current alternating between positive and negative directions as in the case of multi-spark discharge and alternating current discharge spark systems, both well known to those of ordinary skill in the art.

Figure 3:
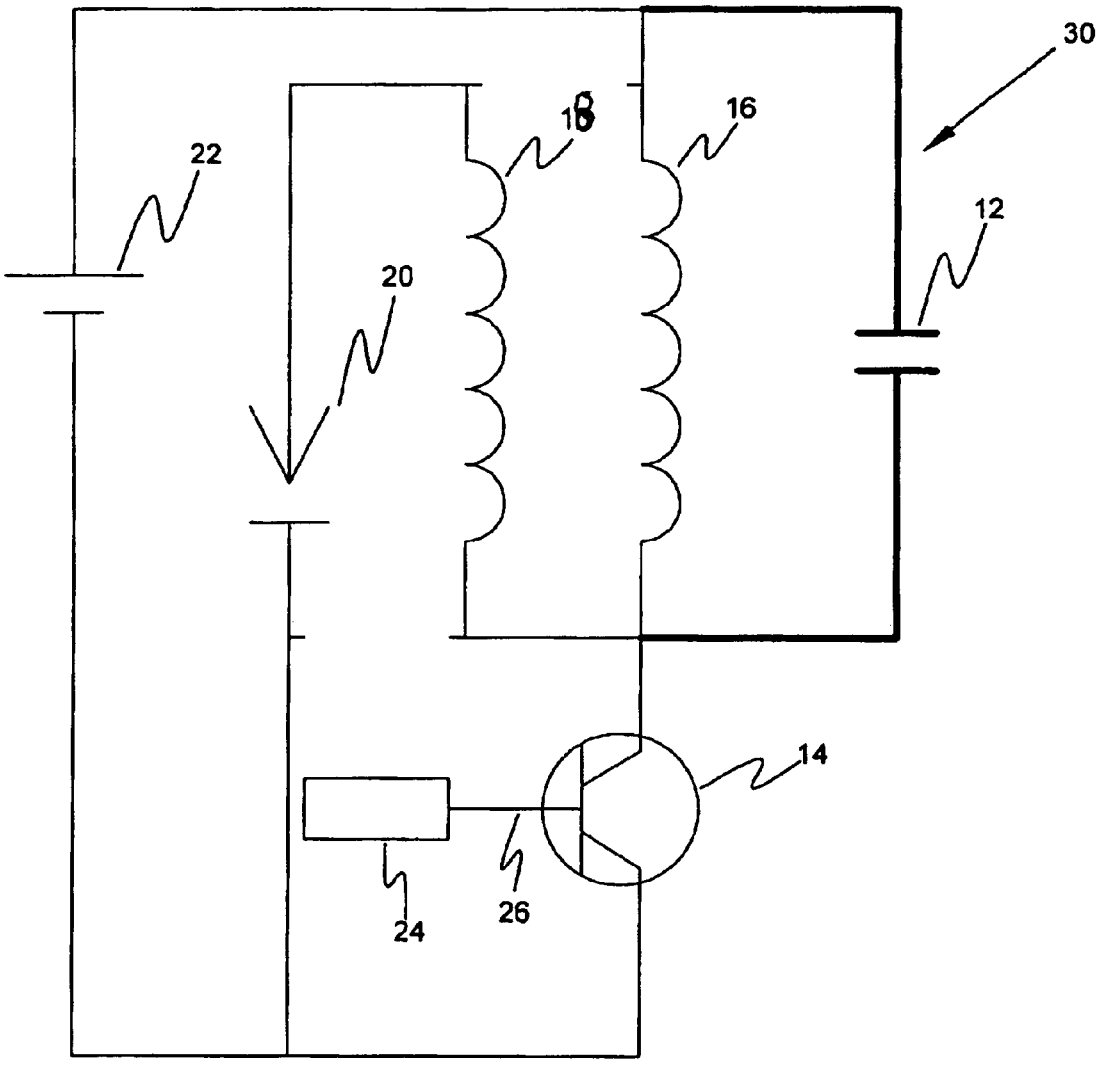
FIG. 3 is an alternative embodiment of the system of FIG. 2 in accordance with the present invention.

Referring now to FIG. 3, an alternative system or circuit for increasing electrical spark current to the spark plugs 20 of an electronic ignition system for internal combustion engines in accordance with the present invention is denoted by numeral 30. The circuit 30 of FIG. 3 is substantially the same as the circuit 10 of FIG. 2 except that the capacitor 12 has been rewired such that the capacitor 12 is parallel with the primary winding 16, and in series with the secondary winding 18 and the transistor 14. The differences between circuit 30 and circuit 10 is that when the capacitor 12 of circuit 10 discharges, corresponding capacitor 12 current flow must travel through the battery 22 resulting in power loss due to long cables and higher circuit resistance. The benefit of circuit 30 is that the capacitor 12 and primary windings 16 are in a closed loop using relatively short wires, thus negating capacitor current travel through the battery 22, reducing circuit resistance and increasing spark current.

Figure 4:
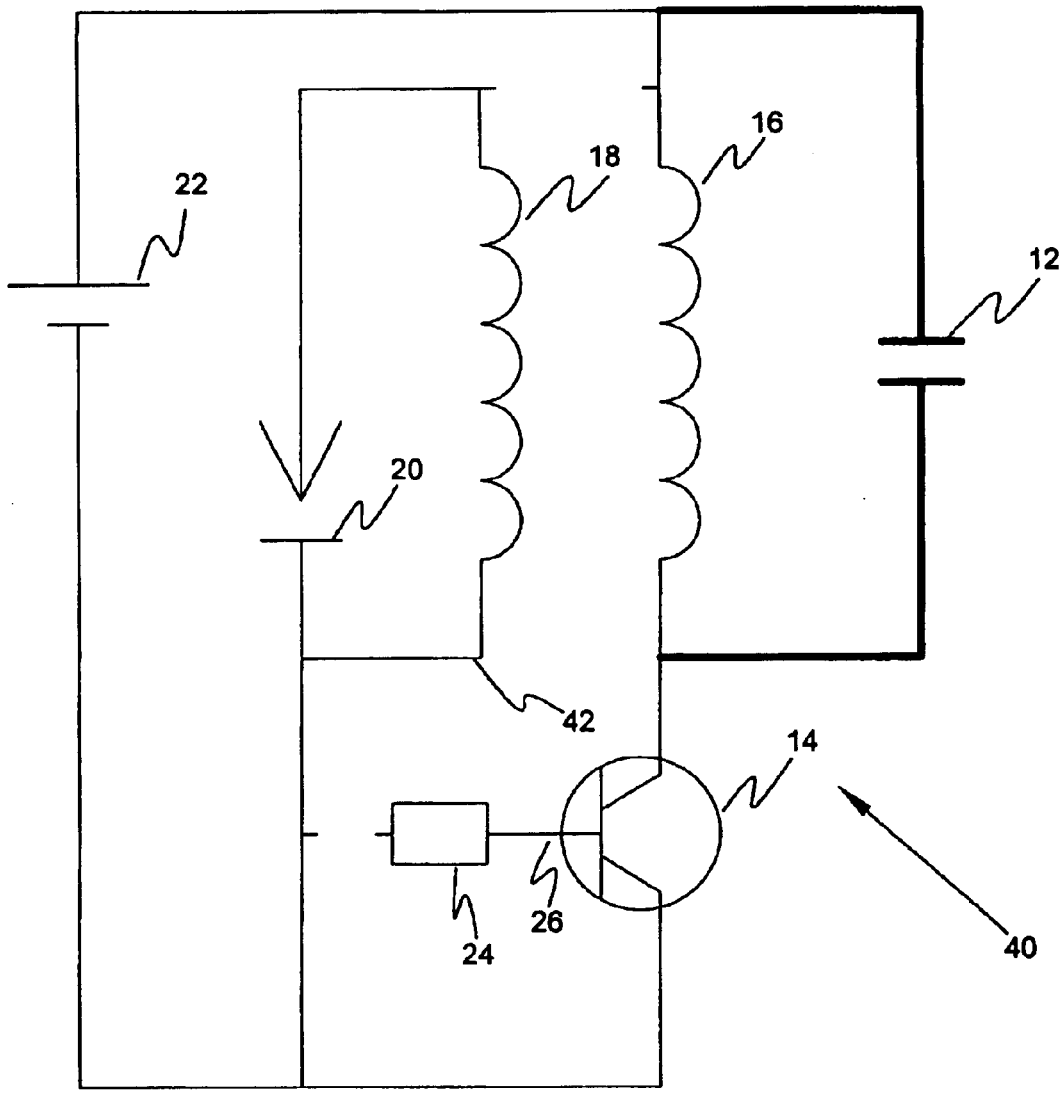
FIG. 4 is another alternative embodiment of the system of FIG. 2 in accordance with the present invention.

Referring now to FIG. 4, another alternative circuit 40 for increasing electrical spark current to the spark plugs 20 is depicted. The circuit 40 of FIG. 4 is substantially the same as the circuit 30 of FIG. 3 except that the secondary winding 18 has been rewired such that the spark plug 20 and the secondary winding 18 are in series in a separate circuit, but magnetically coupled to the primary winding 16. The capacitor current and spark current are the same for circuits 30 and 40. The difference between the two circuits 30 and 40 is that the secondary winding 18 has one terminal 42 connected directly to the negative terminal of the battery 22, the negative terminal is generally grounded. The secondary winding 18 supplies a high voltage output to the spark plug 20 that can be lethal to repair personnel. Grounding one terminal 42 of the secondary winding 18, provides increased safety to individuals who might come in contact with a secondary winding 18 that has not completely de-energized.

Figure 5:
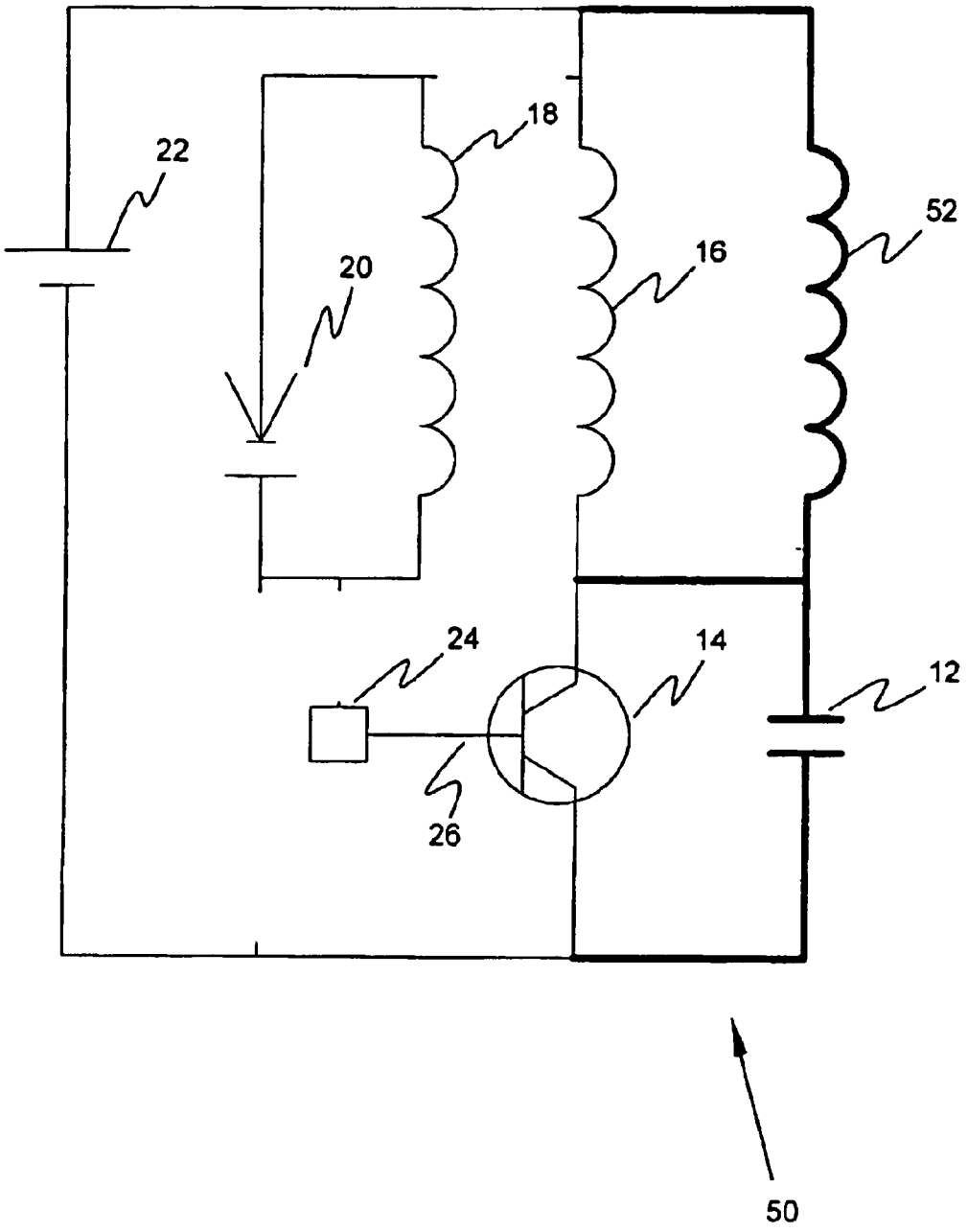
FIG. 5 is another alternative embodiment of the system of FIG. 2 in accordance with the present invention.

Referring now to FIG. 5 another alternative circuit 50 for increasing electrical spark current to the spark plugs 20 is depicted. The circuit 50 of FIG. 5 is similar to the circuit 40 of FIG. 4 except that the capacitor has been placed in parallel with the transistor 14, and an inductor 52 has replaced the position of the capacitor 12 in parallel with the primary winding 16. The parallel inductor 52 reduces the total inductance of the primary winding 16 to a number calculated by a well known formula. Reducing the primary winding 16 inductance, promotes a faster rise time parameter for the winding 16 thereby allowing larger primary winding currents to be reached which results in a correspondingly larger spark current. The inductor 52 is a typical circular coil winding sized between 1 and 50 millihenry, or between 10 and 20 millihenry depending upon the size of the cooperating components in the circuit 50.

Figure 6:
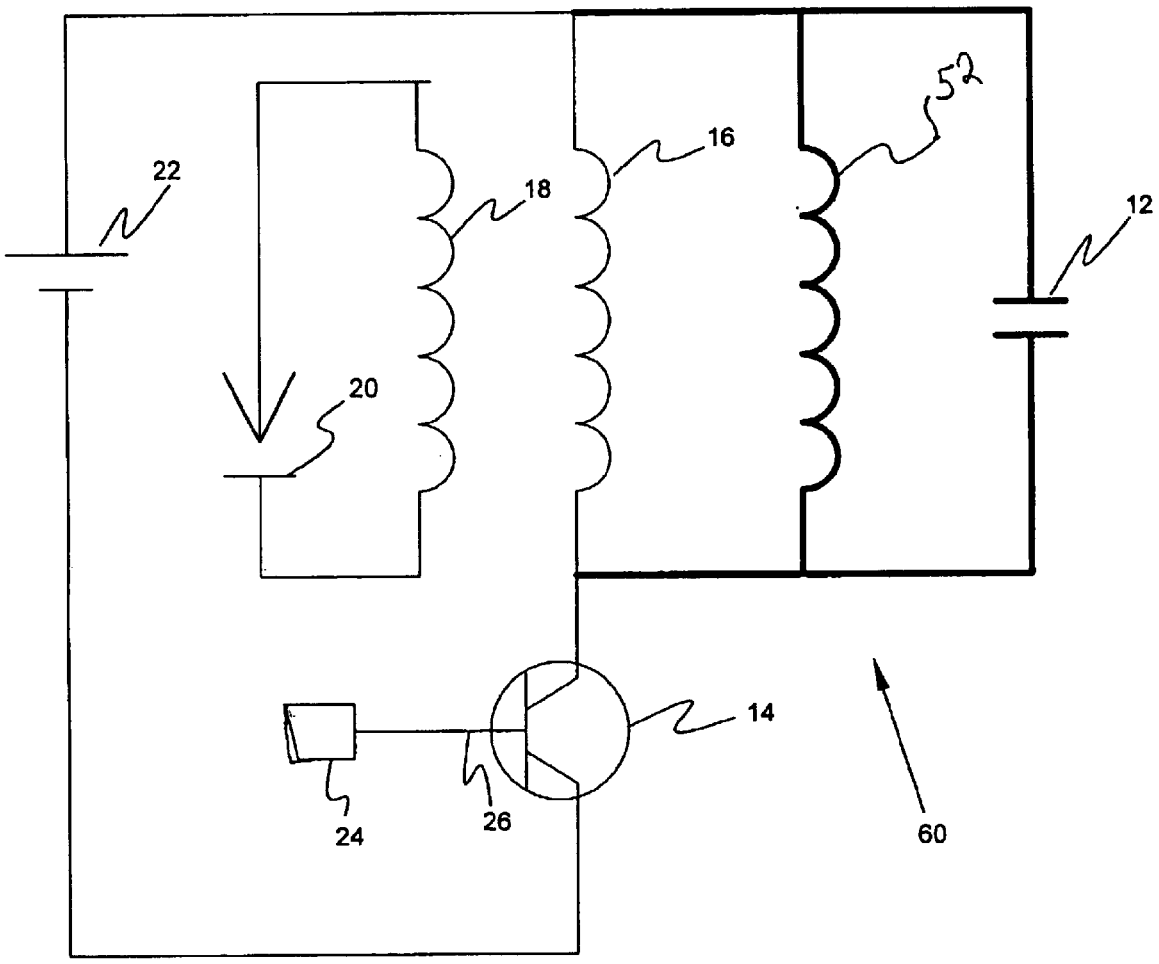
FIG. 6 is another alternative embodiment of the system of FIG. 2 in accordance with the present invention.
Figure 7:
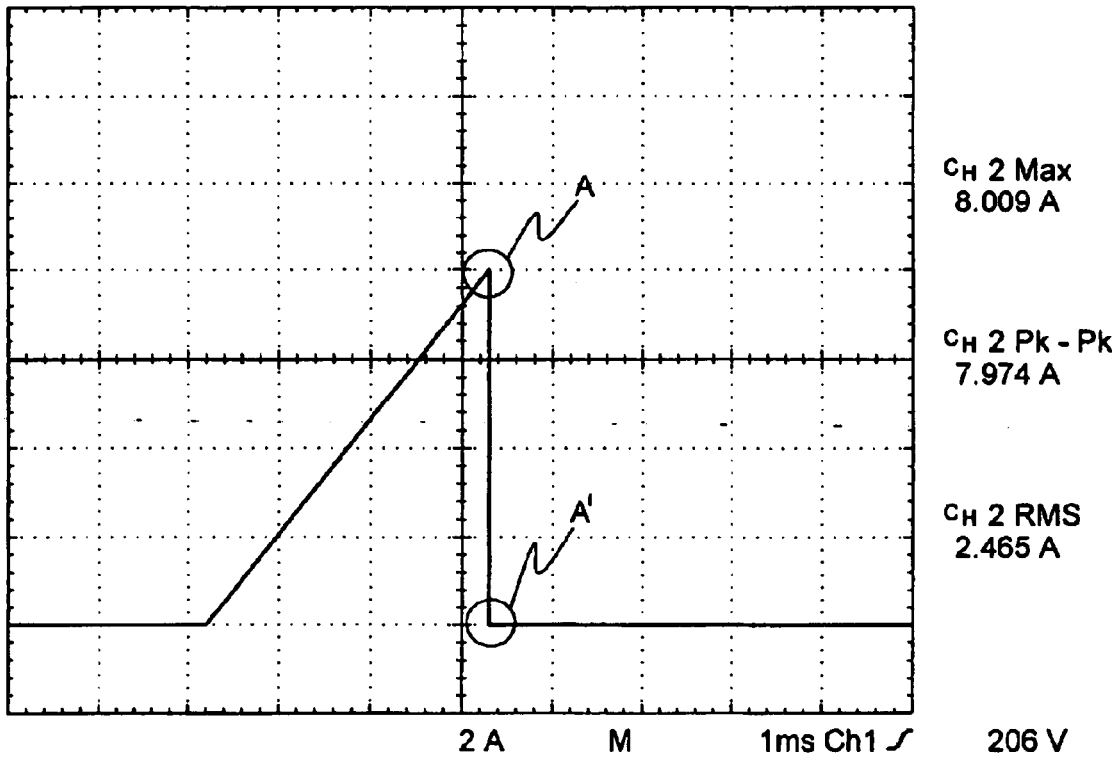
FIG. 7 is a graph of the primary current of the prior art electronic ignition system of FIG. 1, the maximum current reaching a peak to peak magnitude of about 8 amps above a 1 millisecond time line.
Figure 8:
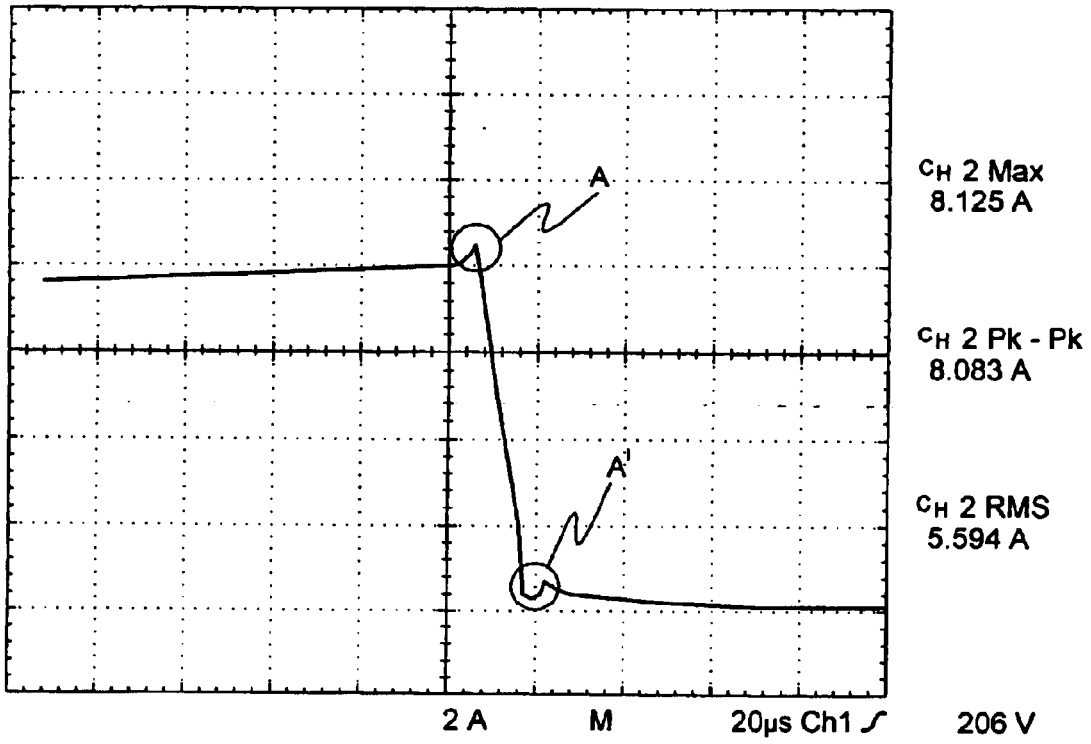
FIG. 8 is a graph of the same primary current of FIG. 7, but above a 20 microsecond time line.
Figure 9:
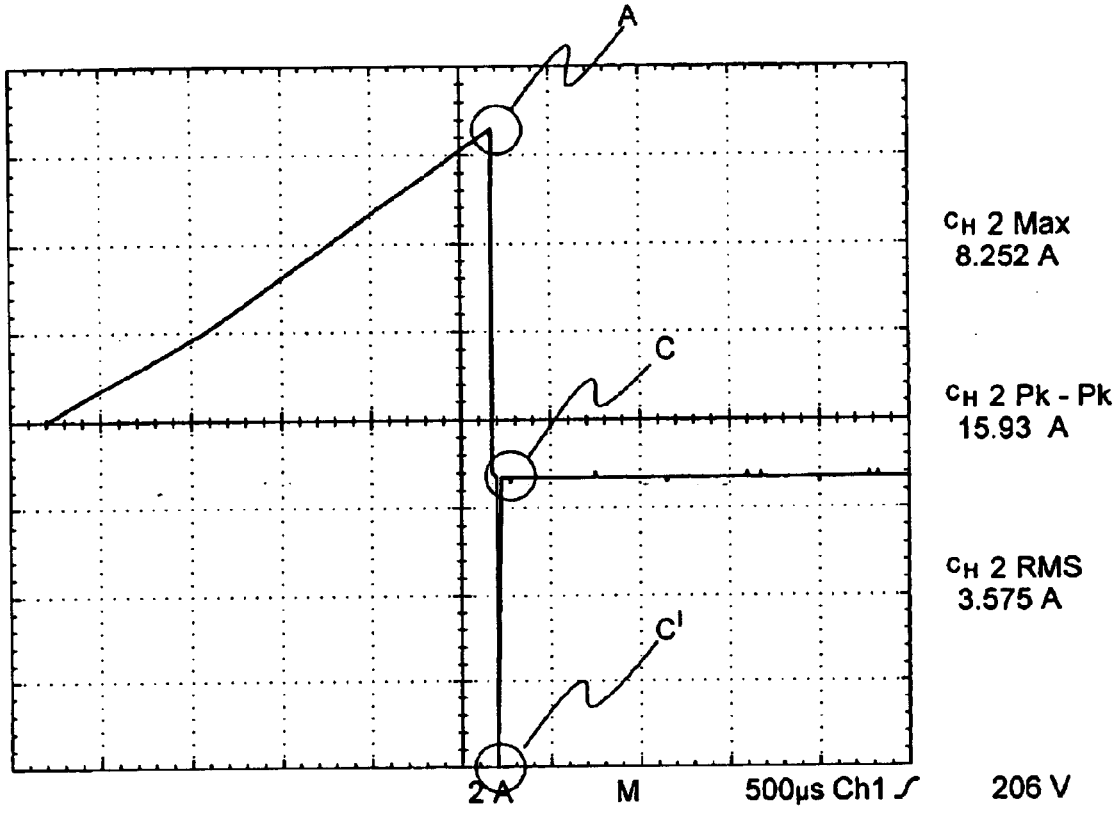
FIG. 9 is a graph of the primary current of the schematic of FIG. 2, the maximum current reaching a peak to peak magnitude of about 16 amps above a 500 microsecond per digit time line.
Figure 10:
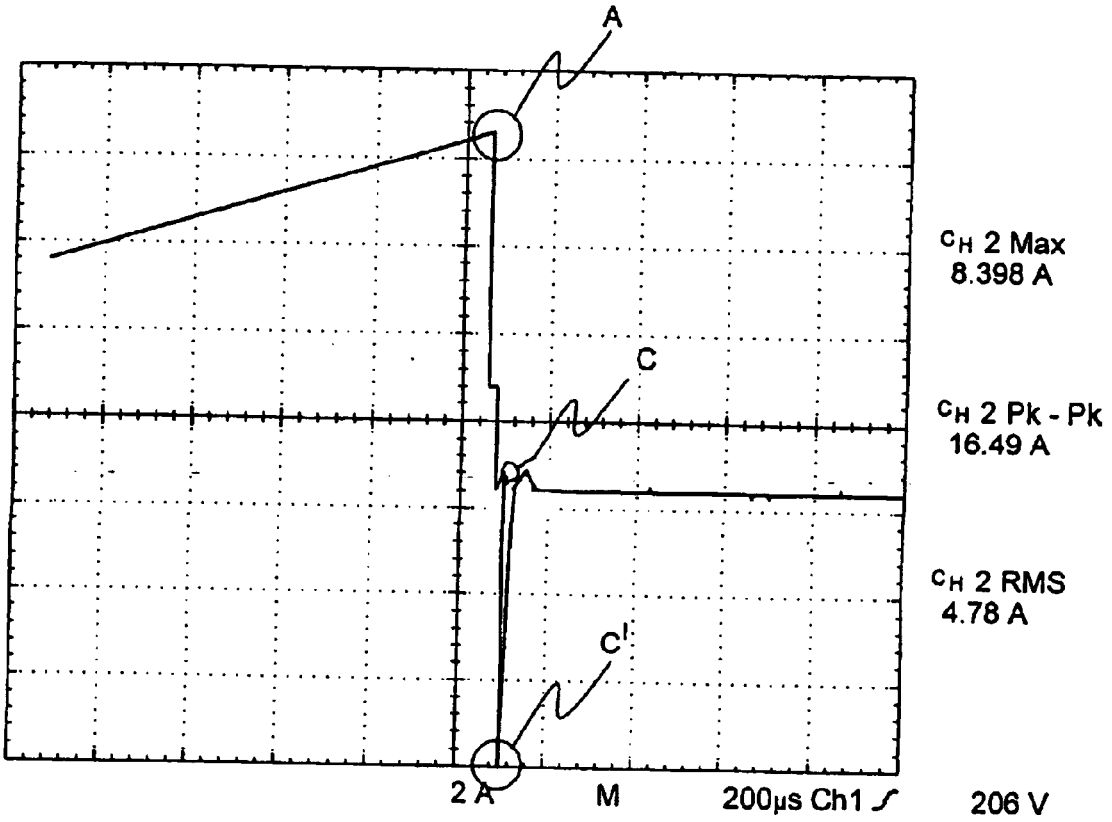
FIG. 10 is a graph of the primary current of FIG. 9, but above a 200 microsecond per digit time line. The graph depicting at C' a negative current overswing.
Figure 11:
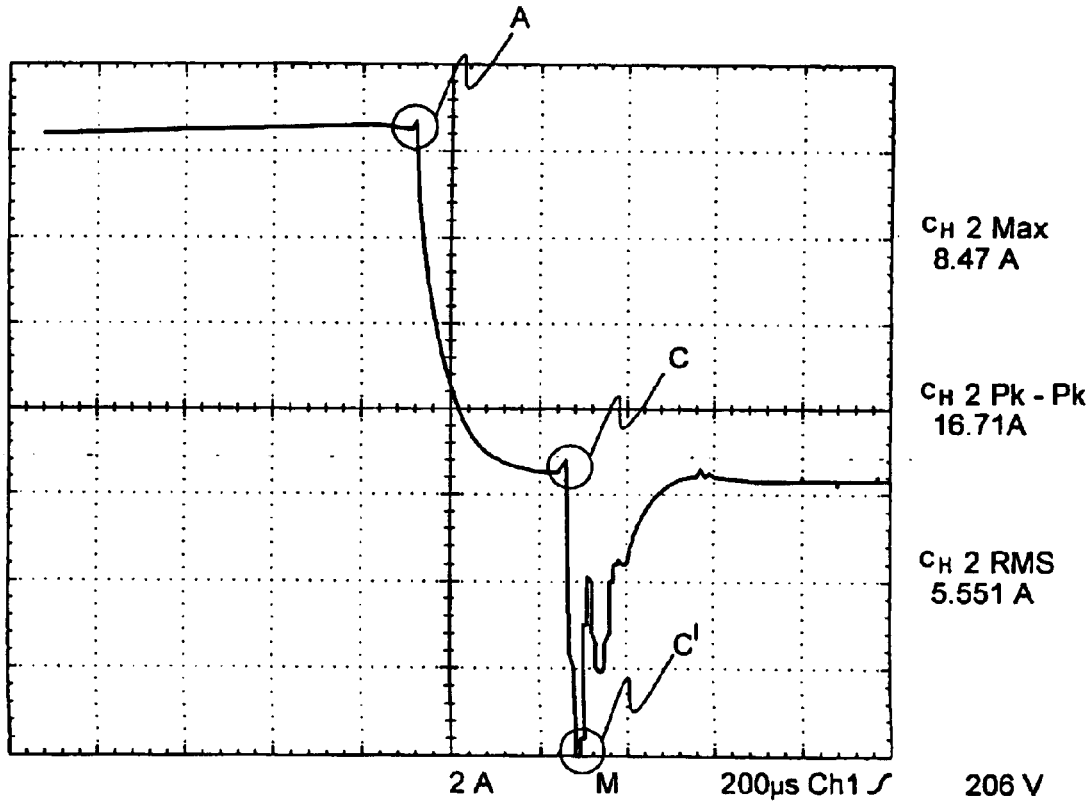
FIG. 11 is a graph of the primary current of FIG. 9, but above a 20 microsecond per digit time line. The graph depicting at C' a negative current overswing that exhibits capacitive decay over time due to a capacitive component in the system.
Figure 12:
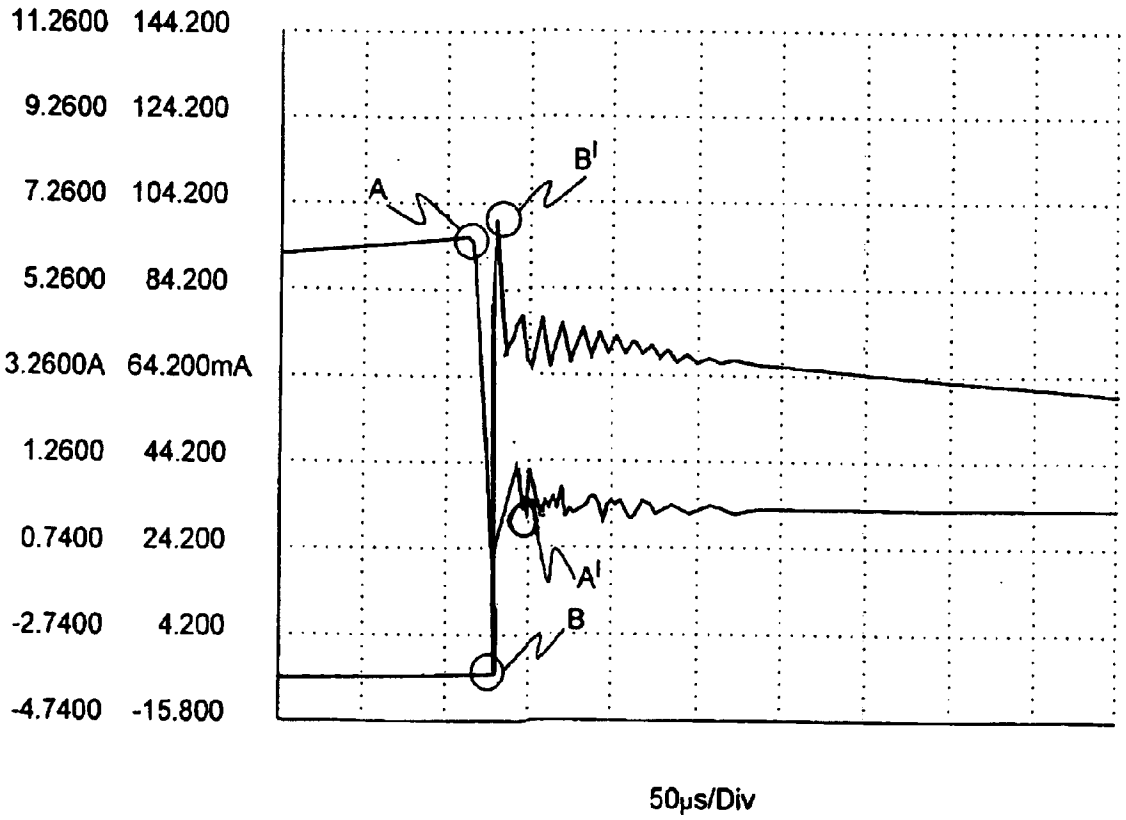
FIG. 12 is a graph depicting the relationship between primary and secondary currents in the prior art ignition system of FIG. 1.
Figure 13:
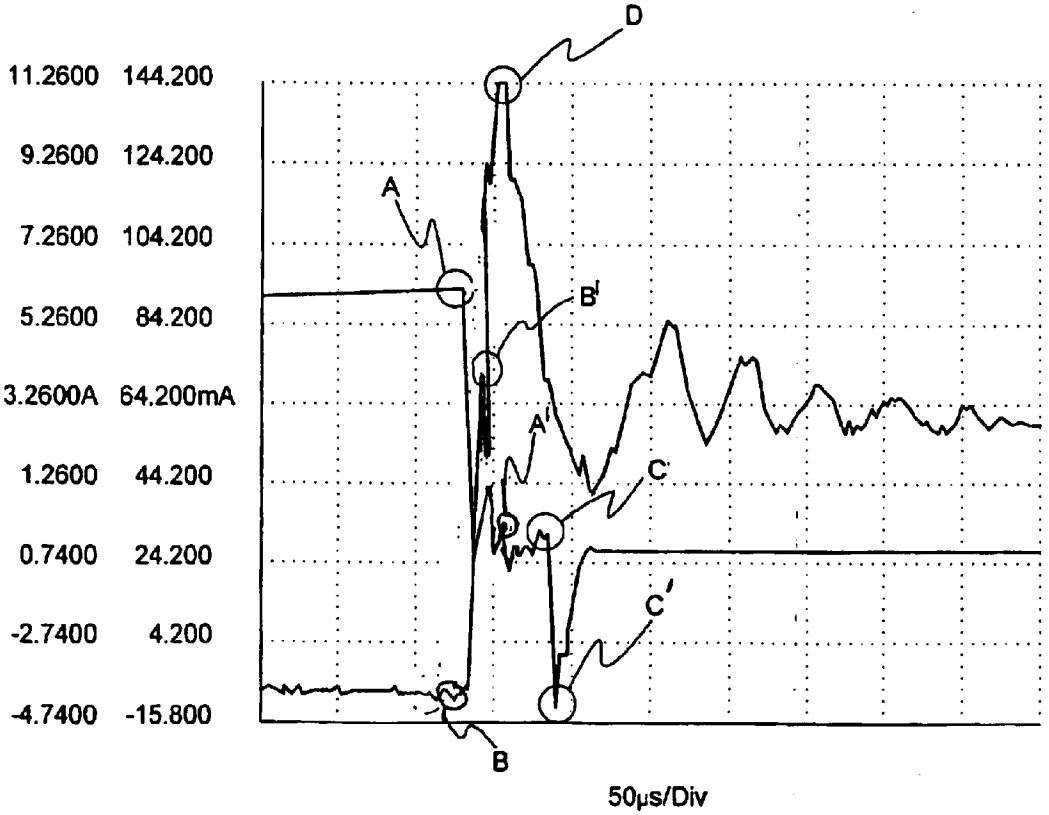
FIG. 13 is a graph illustrating the relationship between primary and secondary currents of the system of the present invention depicted in FIG. 2.

Referring now to FIG. 6, another alternative circuit 60 for increasing electrical spark current to the spark plugs 20 is depicted. The circuit 60 of FIG. 6 is the same as circuit 50 except that the capacitor 12 has been rewired in parallel with the inductor 52. The difference between circuit 60 and circuit 50 is that when the capacitor 12 of circuit 50 discharges, corresponding capacitor 12 current flow must travel through the battery 22 resulting in power loss due to long cables and higher circuit resistance. The benefit of circuit 60 is that the capacitor 12 and primary windings 16 are in a closed loop using relatively short wires, thus negating capacitor current travel through battery 22, reducing circuit resistance and increasing spark current.

Figure 14:
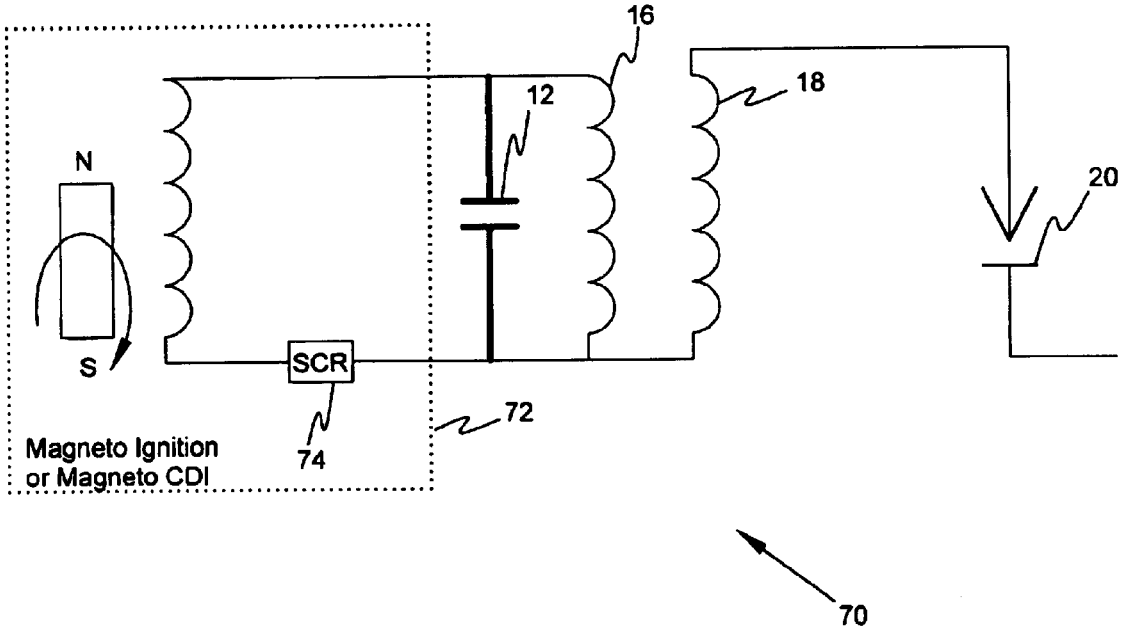
FIG. 14 is an electrical schematic drawing of another alternative embodiment of the system of FIG. 2 in accordance with the present invention.
Figure 15:
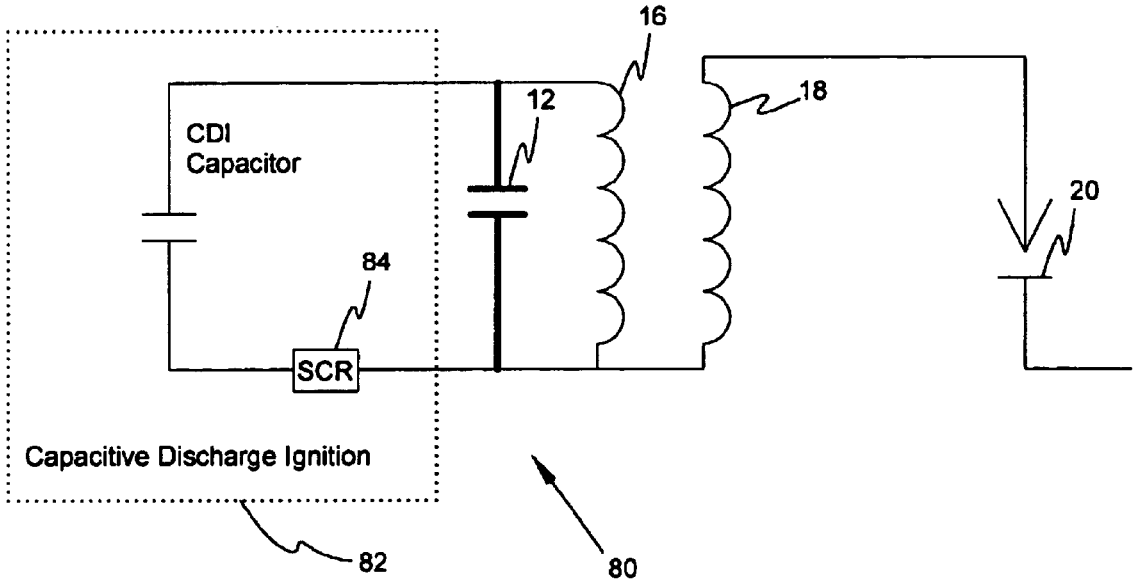
FIG. 15 is an electrical schematic drawing of another alternative embodiment of the system of FIG. 2 in accordance with the present invention.

Referring now to FIGS. 14 and 15, alternative systems 70 and 80 that do not include batteries, are depicted with capacitors 12 that increase primary and secondary currents which correspondingly increase electrical spark in accordance with the present invention. The alternative systems 70 and 80 are substantially the same as the system 30 of FIG. 3 except that the battery 22 and switch 14 have been replaced by a magneto ignition 72 depicted in FIG. 14 and a capacitive discharge ignition 82 depicted in FIG. 15. Silicone Controlled Rectifiers (SCR) 72 and 82 are included in the magneto ignition 72 and the capacitive discharge ignition 82. The principle of operation for the capacitor 12, primary winding 16 and secondary winding 18 of the alternative systems 70 and 80, is the same as the principle of operation for the corresponding components of system 30, detailed above.

The foregoing description is for purposes of illustration only and is not intended to limit the scope of prosecution accorded this invention. The scope of protection is to be measured by the following claims, which should be interpreted as broadly as the inventive contribution permits.

What is claimed is:

1. A system for increasing the spark current to spark plugs of an electronic ignition system for internal combustion engines comprising:

a battery;

an electrical coil having primary and secondary windings;

switching means for energizing and de-energizing said primary winding; and means for directing positive and negative electrical currents through said primary winding whereby a peak to peak primary winding current occurs that induces a corresponding secondary winding current through said secondary winding.

2. The system of claim 1 wherein said secondary winding current has a magnitude greater than a secondary winding current resulting from a primary winding current directed in one direction.

3. The system of claim 1 wherein said directing means includes a capacitive device.

4. The system of claim 3 wherein said capacitive device is sized between 0.01 and 1.0 microfarads.

5. The system of claim 3 wherein said capacitive device is sized between 0.1 and 0.22 microfarads.

6. The system of claim 1 wherein said directing means includes a capacitor wired in series with said primary and secondary windings, and in parallel with said switching means.

7. The system of claim 1 wherein said directing means includes a capacitor wired in parallel with said primary winding, and in series with said secondary winding and said switching means.

8. The system of claim 1 wherein said directing means includes a capacitor wired in parallel with said primary winding, and in series with said switching means.

9. The system of claim 1 wherein said directing means includes a capacitor wired in series with said primary winding and a means for promoting faster primary current rise time, said capacitor also being wired parallel with said switching means.

10. The system of claim 9 wherein said promoting means includes an inductor.

11. The system of claim 10 wherein said inductor is sized between 1 and 50 millihenry.

12. The system of claim 10 wherein said inductor is sized between 10 and 20 millihenry.

13. The system of claim 1 wherein said directing means includes a capacitor wired in parallel with said primary winding and a means for promoting faster primary current rise time, said capacitor also being wired in series with said switching means.

14. The system of claim 13 wherein said increasing means includes an inductor.

15. A method for increasing the spark current to the spark plugs of an electronic ignition system for internal combustion engines, said method comprising the steps of:

providing a power source;

providing a transformer;

providing switching means for energizing and de-energizing a primary winding of said transformer; and directing positive and negative electrical currents through said primary winding whereby a corresponding secondary winding current is induced that ultimately increases the spark across the gap of a spark plug, the step of directing electrical current includes including the step of providing said secondary winding current with a magnitude greater than a secondary winding current magnitude resulting from a primary winding current directed in one direction.

16. The method of claim 15 wherein the step of directing electrical current includes the step of promoting faster primary winding current rise time.

17. The method of claim 16 wherein the step of promoting faster rise time includes the step of providing inductance.

18. The method of claim 15 wherein the step of directing electrical current includes the step of providing capacitance.

19. The method of claim 15 wherein the step of directing electrical current includes the step of wiring a capacitor in series with said primary winding and in parallel with said switching means.

20. The method of claim 15 wherein the step of directing electrical current includes the step of wiring a capacitor in parallel with said primary winding and in series with said switching means.

21. The method of claim 15 wherein the step of directing electrical current includes the step of wiring a capacitor in series with said primary winding and a means for promoting faster primary winding current rise time, said capacitor also being wired in parallel with said switching means.

22. The method of claim 21 wherein the step of wiring a capacitor in series with a means for promoting faster primary winding current rise time includes the step of providing an inductor.

23. The method of claim 15 wherein the step of directing electrical current includes the step of wiring a capacitor in parallel with said primary winding and a means for promoting faster primary winding current rise time, said capacitor also being wired in series with said switching means.

24. The method of claim 23 wherein the step of wiring a capacitor in parallel with a means or promoting faster primary winding current rise time includes the step of providing an inductor.

25. The method of claim 15 wherein the step of directing positive and negative electrical currents through said primary winding includes the step of inducing a secondary winding current in one direction.

26. A system for inducing a spark across the electrodes of a spark plug comprising:

a magneto;

means for energizing and de-energizing a primary winding of a transformer; and means for directing positive and negative electrical currents through said primary winding whereby a peak to peak primary winding current occurs that induces a corresponding secondary winding current through a secondary winding, said secondary winding current having a magnitude greater than a secondary winding current resulting from a primary winding current directed in one direction.

27. The system of claim 26 wherein said directing means includes a capacitive device.

28. The system of claim 26 wherein said directing means includes means for promoting faster winding current rise time.

29. The system of claim 28 wherein said promoting means includes an inductor.

30. A system for inducing a spark across the electrodes of a spark plug comprising:

a capacitive discharge ignition system;

means for energizing and de-energizing a primary winding of a transformer; and means for directing positive and negative electrical currents through said primary winding whereby a peak to peak primary winding current occurs that induces a corresponding secondary winding current through a secondary winding.

* * * * *